US007946513B2

(12) United States Patent
Brick et al.

(10) Patent No.: US 7,946,513 B2
(45) Date of Patent: May 24, 2011

(54) DEVICE AND METHOD FOR IMPROVING GRINDING EFFICACY IN GRAVITY-FED GRINDING MACHINES

(76) Inventors: Jamey O. Brick, Lake Henry, MN (US); Douglas G. Meyer, Clearwater, MN (US); Nick D. Lieser, Lake Henry, MN (US); Dennis D. Finken, Albany, MN (US); Todd J. Marquardsen, Milaca, MN (US)

( * ) Notice: Subject to any disclaimer, the term of this patent is extended or adjusted under 35 U.S.C. 154(b) by 110 days.

(21) Appl. No.: 12/257,873

(22) Filed: Oct. 24, 2008

(65) Prior Publication Data

US 2009/0108110 A1 Apr. 30, 2009

Related U.S. Application Data

(60) Provisional application No. 60/984,202, filed on Oct. 31, 2007.

(51) Int. Cl.
*B02C 13/20* (2006.01)

(52) U.S. Cl. ..... 241/27; 241/187; 241/189.1

(58) Field of Classification Search ..... 241/187, 241/189.1, 73, 27
See application file for complete search history.

(56) References Cited

U.S. PATENT DOCUMENTS 3,726,485 A * 4/1973 Oznibichine ..... 241/32
5,328,103 A * 7/1994 Komarovsky ..... 241/5
5,657,933 A 8/1997 Williams
5,775,608 A * 7/1998 Dumaine et al. ..... 241/242

* cited by examiner

*Primary Examiner* — Mark Rosenbaum
(74) *Attorney, Agent, or Firm* — Altera Law Group, LLC

(57) ABSTRACT

The present invention regulates the delivery of feedstock to the fragmentation zone in a gravity-fed comminuting machine and reduces the ejection of feed materials by means of a rotating cylinder located at an offset position above the rotor. Rotationally mounted on an axis parallel to and above, but offset from, the axis of the rotor, this cylinder serves primarily as a striking surface, or anvil. The continual rotation of the anvil, in the opposite rotational direction as the rotor and with much slower rotational speed, assists in agitating the feed material, alleviating the problems of feed chute obstructions and feed aggregation. The cylinder forces the feed materials into contact with the rotor teeth through continuous rotation and provides a novel tooth design to improve efficacy and reduce wear.

12 Claims, 6 Drawing Sheets

DEVICE AND METHOD FOR IMPROVING GRINDING EFFICACY IN GRAVITY-FED GRINDING MACHINES

CROSS-REFERENCE TO RELATED APPLICATIONS

The present application claims priority to provisional application No. 60/984,202, filed on Oct. 31, 2007 entitled Rotating Anvil for Fragmenting Device, the entire contents of which are incorporated herein by reference.

BACKGROUND OF THE INVENTION

1. Field of the Invention

The present invention relates to comminuting machines in which the feedstock is delivered to a rotary fragmenting machine by gravitational force and, more particularly, to the devices and methods used by gravity-fed grinding machines to improve grinding efficacy.

2. Description of the Related Art

For many applications and work environments, a comminuting machine in which the feedstock enters the fragmentation zone through a gravity chute offers many advantages over machines with other feed delivery and feed rate regulation methods. In a typical machine of this kind, the feedstock is deposited into a gravity chute by a conveyor, auger, or other appropriate device, or by the operating force of another comminuting device. At the bottom of the gravity chute, the feedstock encounters a rotationally powered fragmentation device, commercially known as a rotor or hammer mill, with peripherally mounted comminuting instruments, commonly referred to as teeth, hammers, cutters, and other names suggestive of their function, extending therefrom. These teeth revolve about an axis generally perpendicular to the flow of feed materials at speeds typically exceeding 1000 rpm's, though lower speeds are also found on such devices. When an object enters the radial path of a rotor tooth, it is carried into a plate or bar that is fixed in place and generally labeled an anvil. After the initial striking of the feed material by a rotor tooth, the anvil, located a short distance beyond the outer circumferential path of the teeth, facilitates a second stage of the fragmentation process, as the feed material is subjected to great shearing and pulverizing forces between the radially traveling tooth and the anvil. After the material passes beyond the anvil, it circulates between the teeth and a sizing screen, an apparatus concentrically surrounding a portion of the rotor with apertures roughly the size of the desired finished product. Frangible objects continue to be broken down between the teeth and screening apparatus until they are small enough to pass through these apertures.

The relative simplicity of such a machine, as compared to machines commercially known as horizontal grinders and tub grinders, is an advantage, as well as a disadvantage in certain ways, as described below. Because the feed material enters the fragmentation zone by gravitational force, the power-driven components of the feedstock support and delivery system are not subjected to impact stress from the comminuting process, as they are in horizontal grinders and tub grinders. The drive and driven components of the feedstock conveyance systems for gravity-fed comminuting machines may therefore require less material strength and less maintenance. Gravity feed comminuting machines are particularly suited for processing feedstocks with small particle sizes, including pre-ground wood, bark, asphalt shingles, paper, agricultural waste, and municipal solid waste. Collection of fine debris between components of comminuting machines, a condition commonly present with the aforementioned types of feedstocks, often results in combustion and/or wear. Because the gravity chute separates the power driven feed components from the turbulence of the fragmentation zone, a gravity fed comminuting machine typically is not subject to the same levels of feedstock spillage and collection between feed components as horizontal grinders and tub grinders.

However, such machines generally experience a higher degree of feed rate irregularity than horizontal grinders and tub grinders. Typically, once the feedstock enters the gravity chute, its flow is regulated only by the size of the aperture above the rotor. The feedstock may enter the comminuting zone too quickly, reducing rotor speed, or in more extreme circumstances, stalling the rotor. Manufacturers have attempted to solve this problem by providing adjustable feed openings, such as described in U.S. Pat. No. 5,657,933. Yet this regulation method does not affect another common feed rate problem, the formation of chute obstructions. Friction, cohesion, and adhesion often cause the material flow to cease, slow down, or become irregular, resulting in operational energy inefficiency.

Without a power-driven component forcing the feed material into the fragmentation zone, feed materials may not effectively enter or remain inside the fragmentation zone. The air displaced by the movement of the rotor teeth may push light materials, such as paper and bark, away from the fragmentation zone. The rotor may eject objects from the fragmentation zone upon initial contact. If an object passes over the sizing apertures and travels through the circumferential path of the rotor teeth until it reaches the feed opening, it can escape the comminuting chamber at a high velocity. This feedstock ejection can create several problems. On machines lacking sufficient enclosure, object ejection can pose a serious threat to the persons in the vicinity of the machine, as well as necessitating additional labor to clean the area and handle the unprocessed material.

Feedstock may encounter the rotor teeth several times before passing through a sizing aperture as a result of repeated ejection up into the feed opening and subsequent descent into the comminuting zone. Each encounter with the comminuting zone may result in the feedstock fragmenting into smaller pieces. In these situations, machine operators may not experience effective control over particle size and texture. Repeated and excessive contact between the rotor teeth and individual pieces of feed material also reduces production efficiency and increases component wear in proportion to output.

In some gravity-fed comminuting machines, this material ejection and reintroduction to the comminuting zone problem is addressed with long feed chutes that increase the momentum and/or gravitational compression of the feed material entering the fragmentation zone. The height of a long feed chute may increase the cost of a machine and the equipment operating in coordination with it and decrease the machine's application versatility. Gravity fed comminuting machines, commercially known as wood hogs, are often installed in systems customized to specific environments and applications to operate in tandem with other machines. The size and shape of the gravity chute can significantly limit the feeding method options in comparison to horizontal grinders and tub grinders.

These problems, among others, limit the use of such known gravity-fed comminuting machines primarily to static operation within automated systems, such as commonly found in municipal solid waste processing plants, sawmills, and other facilities with constant flows of heterogeneous feedstocks. Machines of this kind are typically selected for their low investment costs and supervision requirements resulting from their relative simplicity. An effective solution to the problems inherent to gravity-fed comminuting machines must alleviate these problems without significantly increasing the cost or complexity of the basic design, a primary objective of the present invention.

The present invention addresses, inter alia, these listed deficiencies in the known devices.

BRIEF SUMMARY OF THE INVENTION

The present invention regulates the delivery of feedstock to the fragmentation zone in a gravity-fed comminuting machine and reduces the ejection of feed materials by means of a rotating cylinder located at an offset position above the rotor. Rotationally mounted on an axis parallel to and above, but offset from, the axis of the rotor, this cylinder serves primarily as a striking surface, or anvil. The continual rotation of the anvil, in the opposite rotational direction as the rotor and with much slower rotational speed, assists in agitating the feed material, alleviating the problems of feed chute obstructions and feed aggregation. The cylinder forces the feed materials into contact with the rotor teeth through continuous rotation and provides a novel tooth design to improves efficacy and reduce wear.

In addition to helping maintain consistent feed and sizing rates, the present invention presents a substantial improvement over stationary and pivotally mounted anvils, particularly in regard to maintenance requirements and procedures. The rotating anvil's drum and striking plates increase the surface subjected to wear and impact, thereby extending the service life of the rotating anvil, without decreasing the circumferential space that can be devoted to the sizing apparatus. The rotation of the anvil protects the striking plates from the heat generated by the comminuting process, which accelerates wear on typical anvils, allowing heat to dissipate from each plate as it travels out of the fragmentation zone in its radial path. Its rotational mounting improves access to the striker plates for inspection and maintenance procedures. Located above, and offset from, the rotor, rather than abutted to the screening apparatus like a typical anvil, the rotating anvil pushes material into the rotor teeth without its movement allowing particles to bypass the screening apertures, ensuring accurate, efficient product sizing.

An object of the invention is to provide a device and method having larger wear surface than a typical anvil to increase the anvil's operating life.

Another object of the invention is to provide a device and method that allow heat to dissipate from each striking plate as it travels out of the fragmentation zone. Heat generated by the grinding process can accelerate the wear of an anvil. The time period in which each plate is subjected to the heat and force of the grinding process is less than the time it spends outside the fragmentation zone.

Another object of the invention is to provide a device and method for feeding materials to the rotor teeth, actively forcing the material into the teeth, unlike a typical anvil, which simply receives the impacts of material delivered to it. Light, loose materials (e.g., pre-ground wood, bark, paper) have a tendency to be ejected from the grinding chamber in machines in which the feedstock enters the grinding chamber by gravity alone (unlike tub grinders and horizontal grinders, which have power-driven feed components that may be supporting and moving the feed material as it is being struck by the rotor teeth/hammers). The rotating anvil forces material into contact with the teeth.

Another object of the invention is to provide a device and method that prevents feed bridging and clumping and maintains a consistent feed rate. The present invention agitates the feed material, preventing feed obstructions and feed surges.

Another object of the invention is to provide a device and method that prevents materials from being ejected from the grinding chamber.

Another object of the invention is to reduce anvil maintenance downtime through improved anvil access. The rotational mounting of the anvil on a shaft allows maintenance personnel to inspect and service the entire wear surface of the anvil without moving the screen or hydraulically actuating the anvil.

The figures and the detailed description which follow more particularly exemplify these and other embodiments of the invention.

BRIEF DESCRIPTION OF THE DRAWINGS

The invention may be more completely understood in consideration of the following detailed description of various embodiments of the invention in connection with the accompanying drawings, which are as follows.

DETAILED DESCRIPTION OF THE INVENTION, INCLUDING THE BEST MODE

Figure 1:
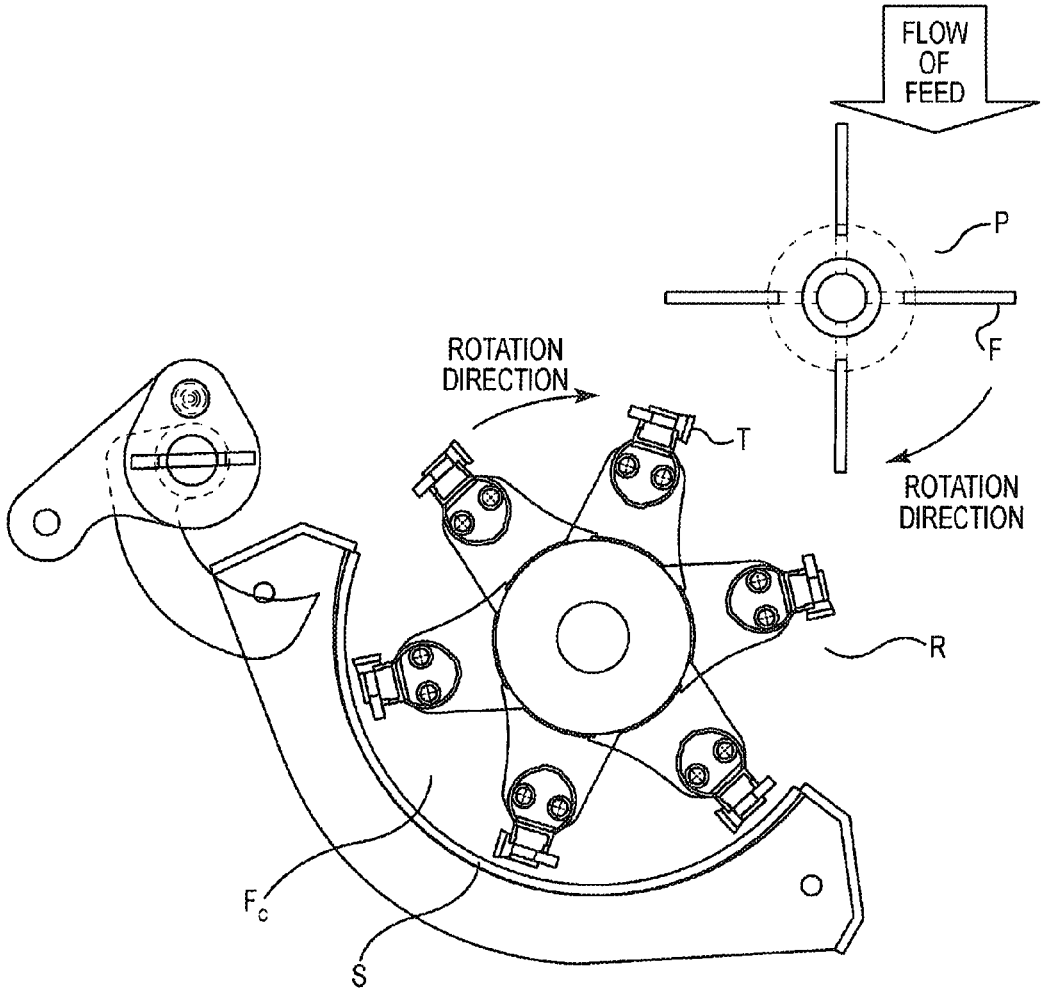
Fig. 1 PRIOR ART
FIG. 1 is a side cutaway view of a prior art gravity-fed fragmenting device.

While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention.

FIG. 1 illustrates a prior art device wherein a powerfeed mechanism is disposed above the fragmenting rotor and within the feed chute to help feed the material to the fragmenting rotor. This powerfeed mechanism spins or rotates in the same direction as the fragmenting rotor and at a high rate of speed, e.g., in the range of, or exceeding, 1000 rpm. The same-direction rotation for the powerfeed and the fragmenting rotor means that a rotor tooth at the uppermost point of its circumferential pathway and a feeding plate at the lowermost point in its pathway will result in assisted radial movement of the feed material. As can be appreciated from the illustration, the flow of feed material in the known device of FIG. 1 results in the material being powerfed in a direct and essentially unbroken path to the rotor wherein the rotor's teeth sweep the feed material into the fragmenting chamber. As the rotor contacts the feed material, it is carried away from the powerfeed with minimal fragmentation occurring between the powerfeed and the rotor for the incoming feed material. One key aspect of this known device provides the feed material being introduced by the feed chute at a location where the feed material is bound to be contacted and urged downward by the powerfeed mechanism and into the path of the rotating fragmenting rotor, and in the same radially directional flow as the oncoming fragmenting rotor teeth. Stated differently, the direction of the feed material as it is dropped into the path of the powerfeed, the direction of rotation of the powerfeed and the direction of rotation of the fragmenting rotor are all complementary and designed to power the feed material into the path of oncoming fragmenting rotor teeth.

Thus, both the powerfeed and the fragmenting rotor of this prior art device are illustrated as rotating in a clockwise manner. The feed material is dropped into the feed chute on the right side of the powerfeed as illustrated in FIG. 1 to take advantage of the downstroke of each feed plate as it rotates through the feed material.

The known device of FIG. 1 comprises a powerfeed P that is primarily a feeding mechanism, with the feed material falling into the powerfeed P with subsequent delivery to the fragmenting rotor R and its teeth T, but with less than optimal fragmenting, i.e., striking and shearing actions, as a consequence of the flow and acceleration of the feed material on its first encounter with the fragmenting rotor R. The flow of feed material is pushed along feeding plates F by the fragmenting rotor R which feeds the feeding material into the pathway of oncoming flat rotor teeth T, but the feed material in this known device avoids any shearing collisions between the feeding plates F and rotor teeth T for a complete revolution around the fragmenting or grinding chamber Fc, which is the partially enclosed space defined by the rotor R and apertured sizing screen S. After the feed material ultimately does encounter the teeth T of the fragmenting rotor R, the feed material is carried away from the powerfeed P by the rotor R. As a result, material that reencounters the powerfeed P for subsequent feeding to the fragmenting rotor R will have circulated around the fragmenting chamber Fc before finally being caught between the powerfeed P and the fragmenting rotor R. Moreover, since the powerfeed device P and the fragmenting rotor R are rotating in the same general direction, as indicated by arrows, and with relatively high rotational speeds, the force generated at the point of impact will be very large, resulting in increased stress and wear on the flat rotor teeth T, as well as the powerfeed P and its feeding plates F.

Figure 2:
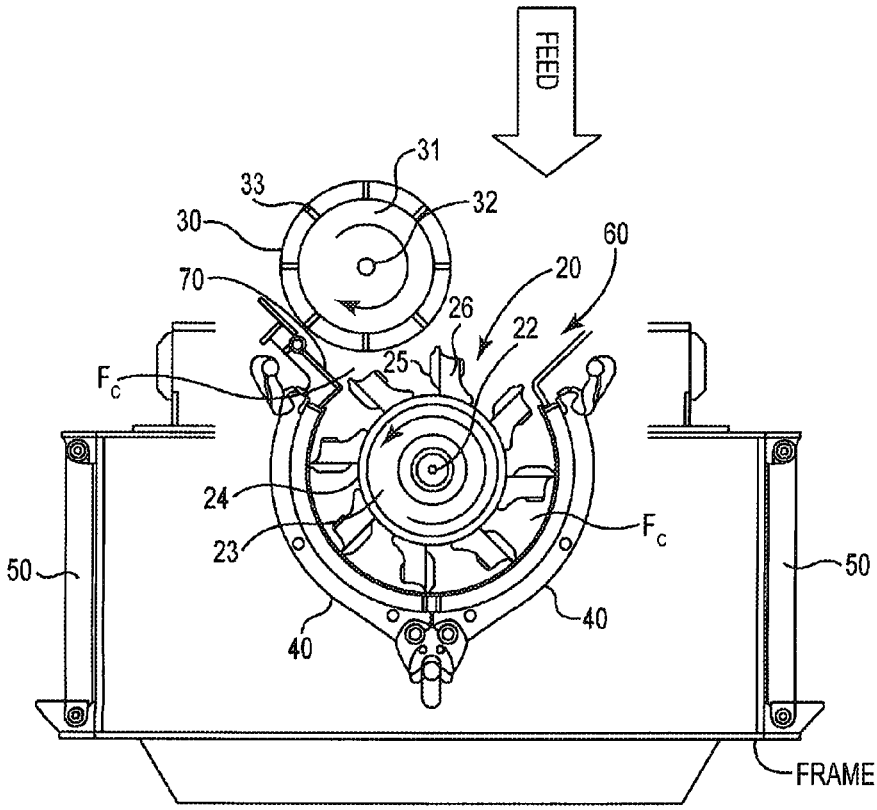
FIG. 2 is a side cutaway view of one embodiment of the present invention.
Figure 3:
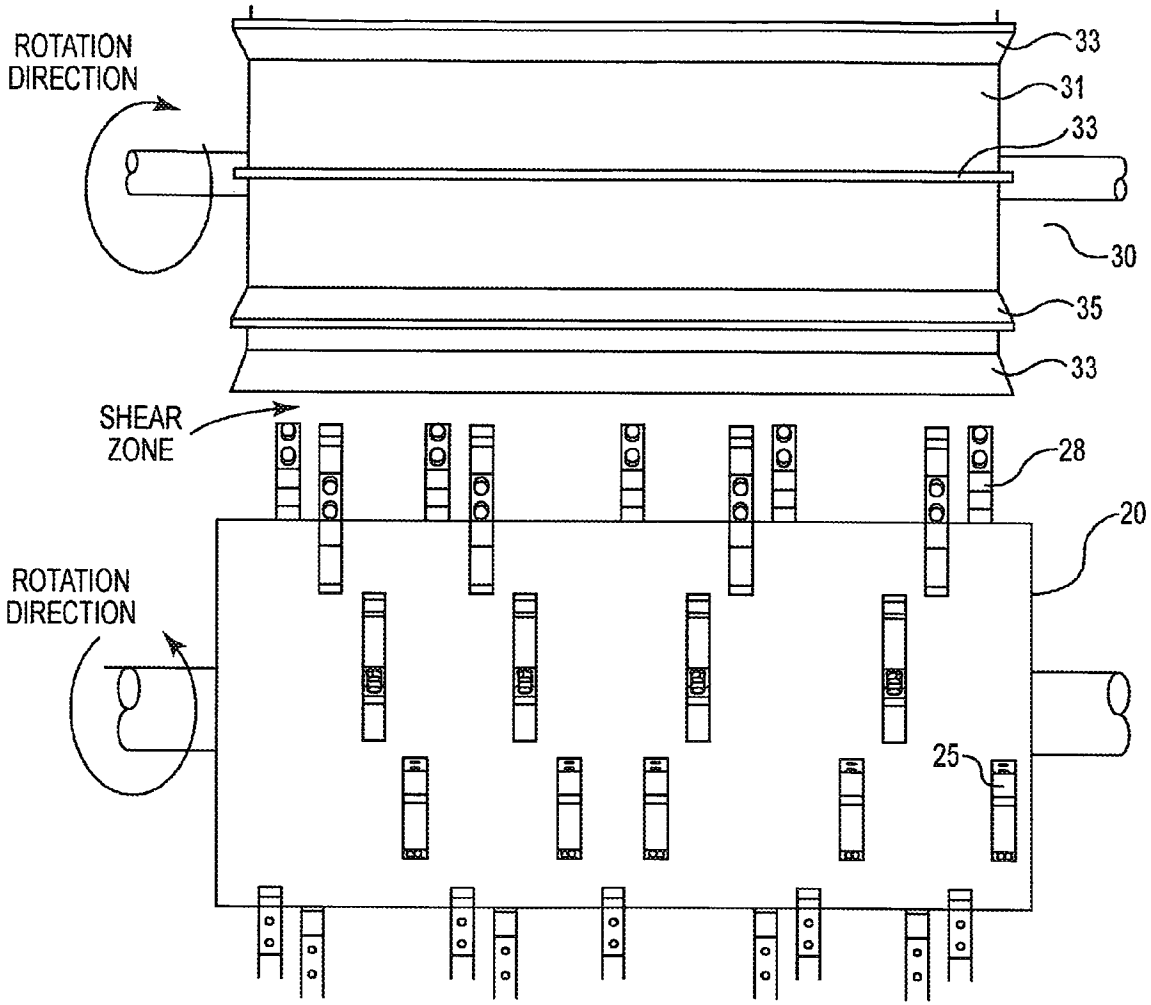
FIG. 3 is a top cutaway view of one embodiment of the present invention.

FIGS. 2 and 3 illustrate one embodiment of a gravity-fed rotary fragmenting device 10 of the present invention. Fragmenting device 10 comprises a frame and fragmenting rotor 20, a rotating anvil 30, at least one, preferably two, screen(s) 40, opposing access panels 50, a feed chute 60 and a strike plate 70 all in operative attachment with frame.

Generally, the present invention comprises obvious differences and advantages as compared with the prior art device of FIG. 1. Initially, the feed material is dropped down the feed chute 60, where the fragmenting rotor 20 is rotating in a counterclockwise manner, in opposition with, or in a non-complementary direction to, the feed material's gravity-driven downward path. This results in the feed material impacting the fragmenting rotor teeth 25, with an abrupt and fragmenting directional and velocity change for the feed material, from a relatively slow and generally downward descent to a high-speed and upward and counterclockwise radial pathway enroute to collision with the striking plates 33 of rotating anvil 30 which is rotating slowly in a clockwise manner; opposite to the counterclockwise rotation of rotor 20.

The fragmenting rotor 20 comprises an axis 22 that is operatively connected to a power source, e.g., a driving motor, by means that the skilled artisan will readily recognize. The fragmenting rotor 20 thus rotates about axis 22 in one rotational direction as indicated by the arrow. Fragmenting rotor 20 further comprises a cylindrical drum 23 having an outer surface 24. More than one tooth 25 is mounted on the outer surface 24. As illustrated, each such tooth 25 is operatively connected to a mounting bracket 26 wherein the bracket 26 is removably and fixedly attached to the outer surface 24 and the teeth 25 are removably and fixedly mounted to the leading surface 27 of the corresponding bracket 26, by means well known to the skilled artisan, e.g., bolted. As illustrated, the teeth 25 are evenly distributed radially around the rotor's outer surface 24. This embodiment is a most efficient and thus preferred fragmenting arrangement, though other embodiments may comprise teeth 25 having unequal distribution around the rotor's outer surface 24, e.g., the distance between each tooth 24 is not equal. Various axial distributions and arrangements of the teeth 25 on outer surface 24 of rotor 20 is discussed in further detail in connection with FIG. 4.

The rotating anvil 30 comprises a cylindrical drum 31 that rotates on a horizontal axis 32 that is parallel to the rotational axis 22 of the fragmenting rotor 20 and is operatively connected to a power source, e.g., a driving motor, by means that the skilled artisan will readily recognize. The rotor axis 22 and the anvil axis 32 are generally perpendicular to the flow of feed material F, which enters the fragmentation zone FZ through a gravity feed chute 60. The anvil 30 rotates at the side and bottom of this feed chute 60, thus partially defining feed chute 60, and is positioned just above the rotor 20 and, as illustrated, offset transversely from the rotor 20 to assist in defining feed chute 60.

More than one striking plate 33 is mounted to drum 31 and each plate 33 extends radially outward from the drum 31 at evenly spaced distances from each other, and at equivalent angles in relation to the drum 31, in the preferred embodiment. However, plates 33 may be unequally spaced from each other, and/or the angles in relation to the drum 31, may vary in other embodiments. These plates 33, inter alia, assist in agitating material in the feed chute 60, push incoming, and recirculating, feed material into the rotational pathways of the rotor teeth 25 and comprises surfaces and edges upon which the feed material is fragmented generally. The anvil 30 rotates in the opposite rotational direction as does the fragmenting rotor 20 and is in operative communication with feed chute 60 and fragmenting rotor 20.

Thus, anvil 30 and plates 33 are moving in a rotational radial path as illustrated by the arrow in FIGS. 2 and 3. Rotor 20 and the individual teeth 25, mounted to brackets 28, are moving in a rotational radial path also shown by rotational arrow. As described above, the rotational directions of anvil 30 and rotor 20 are opposing, but the anvil 30 preferably is rotating far slower than is the rotor 20 to provide striking and shearing surfaces. A striking and shear zone is provided at the point of proximity between a rotating plate 33 and individual rotating teeth 25.

As a result, it is an aspect of the present invention that, in a preferred embodiment, the anvil 30 rotates at a much slower rotational speed than that of the rotating rotor 20. However, it is within the scope of the invention that the anvil 30 and the rotor 20 comprise substantially similar and/or equivalent rotational speeds in alternate embodiments. Further alternate embodiments may comprise and combination of speed differential between the extremes.

As briefly discussed supra, it is also an aspect of the present invention that in certain embodiments, the feed chute 60 is oriented to gravitationally direct feed material downwardly directly to the fragmenting rotor teeth 25 and in a non-complementary direction, as opposed to the complementary introductory directions of the feed material and the fragmenting rotor of the prior art device of FIG. 1. Instead, the present invention comprises the feed material being directed directionally substantially downward and into the path of rotor teeth 25 which are moving in an opposing direction, resulting in a significant striking and shearing event and abrupt velocity and directional change. In this manner, the feed material experiences an initial fragmentation and is directed at high speed next into the path of the slower rotating anvil 31, particularly the anvil's plates 33 and drum 31 where further striking and shearing fragmentation occurs. The direction and/or angle of the feed material as it exits feed chute 60 and the relative oppositional direction and angle of the oncoming rotor teeth 25 at the entry or strike point as this feed material encounters the fragmenting rotor teeth 25 may be varied to obtain varying degrees of initial fragmentation as will be readily understood by the skilled artisan. Each such embodiment will comprise non-complementary, i.e., opposing, directions of feed material entry with respect to the rotational direction of the rotor teeth 25 and the striking plates 33 at entry or strike point.

As one of the anvil's striking plates 33 move rotationally about axis 32, the plate(s) 33 move into successive rotational positions above the rotor 20, wherein at least one of the plates 33 will reach a point of closest proximity with at least one of the rotating teeth 25 as the teeth 25 move rotationally around axis 22, thus creating a pinch point between the plate 33 and the most proximal tooth and/or teeth 25. In this way, a shear zone is established between the rotating plates 33 and the rotating teeth 25 within which the feed material is fragmented by shearing force of the teeth 25 rotating past the plate(s) 33. The distance of the point of closest proximity between the teeth 25 and the plates 33 is dependent upon the type of feed material and, as those skilled in the art will recognize, may be varied to optimize. This shearing action is made possible, in part, by the anvil 30 and the fragmenting rotor 20 having opposing rotational directions.

The anvil 30 is positioned above the rotor 20, rather than connected to or abutted to the screen like a typical stationary anvil. The anvil 30 rotates in the opposite direction as the rotor 20, but at a much slower speed, the plates 33 serving as both shearing and striking surfaces for the oncoming feed material driven by the rotating teeth 25. Thus, as each plate 33 rotates into position above the rotor 20, it is moving in the same general direction of the feed material that is being pushed forward by the teeth 25. The feed material is fragmented, i.e., sheared and/or pulverized, between the anvil plate 33 and teeth 25.

As described above, the opposite direction rotation of the anvil 30 and the fragmenting rotor 20 allows feed material to first be directed to the shear zone between the anvil's plates 33 and the rotor's teeth 25 where a good deal of fragmenting may occur. Once the feed material rotates through the shear zone, driven by the fragmenting rotor teeth 25 and the anvil plates 33, the feed material will be delivered at a high rate of speed into a strike plate 70, which is fixed in position, where further fragmenting of the feed material as it encounters forces generated between the fixed strike plate 70 and the rotor's teeth 25. Additionally, at this point, there may be a tendency for some feed material to be redirected upwardly generally due to the force of impact upon the strike plate 70. The positioning of the rotating anvil 30 as illustrated in FIGS. 2 and 3, at a point above and adjacent the strike plate 70, and the slow clockwise rotation of the anvil 30, with downward redirection of the upwardly moving feed material by contact with plates 33 in the region of strike plate 70, effectively serve to further fragment the feed material and rotatingly drive the upwardly moving feed material back down into the pathway of the oncoming rotor teeth 25.

After the initial shearing and striking of the feed material has occurred and the strike plate 70 has been cleared, the feed material will then enter a subsequent stage of the fragmentation process, circulating between the rapidly rotating teeth 25 and a sizing screen 40, shown in closed position in FIG. 2 and in open position in FIG. 3, an apparatus concentrically surrounding a portion of the rotor with apertures roughly the size of the desired finished fragmented product. The feed material will continue to be broken down between the screen 40 and the teeth 25 until they are reduced in size so that they may pass through the screen apertures. The device of FIG. 3 also illustrates access panels 50 in an open position wherein access panels 50 are hingedly swung open to allow access while FIG. 2 illustrates the access panels 50 in closed position.

FIG. 3 illustrates a top view of the rotating anvil 30 and fragmenting rotor 20, with rotational directions as indicated by the arrows. As can be seen, this embodiment provides strike plates 33 that are elongated and extend along the drum 31. As illustrated, the plates 33 are distributed evenly around the perimeter of drum 31, wherein the distance from plate 33 to the next plate 33 is substantially equivalent. Alternate embodiments may comprise an uneven distribution of plates 33 around at least a portion of the perimeter of drum 31.

The fragmenting rotor is illustrated with a plurality of mounting brackets 26 attached to the outer surface 24 of drum 23. Rotor teeth 25 are removably attached via bolts to mounting brackets 26. As illustrated, the brackets 26 and teeth 25 are arranged in rows with varying axial distances between brackets 26 within a given row. The next successive row in the arrangement of brackets 26 and teeth 25 is spaced such that there is no overlap with the previous row of brackets 26 and teeth 25 to provide an efficient fragmenting structure. Between the fragmenting rotor 20 and the rotating anvil 30 is a shear zone where feed material is pinched and sheared as is described above.

Typical known teeth used in grinding and/or fragmenting devices that are designed for grinding wood and the like typically produce a pulverizing, shearing, cutting and/or splitting force as their primary means of reducing the material. These known teeth typically have a pointed surface that leads into the material in some manner or there may be more than one such pointed surface.

Known teeth used to process difficult materials, e.g., contaminated materials, may be flat, i.e., parallel to the front of the tooth mounting bracket. This arrangement is used to extend the tooth's lifespan by providing a blunted striking surface rather than a pointed surface. Such a blunted striking surface produces pulverizing and shearing forces, but generally does not produce splitting and/or cutting forces.

Figure 4:
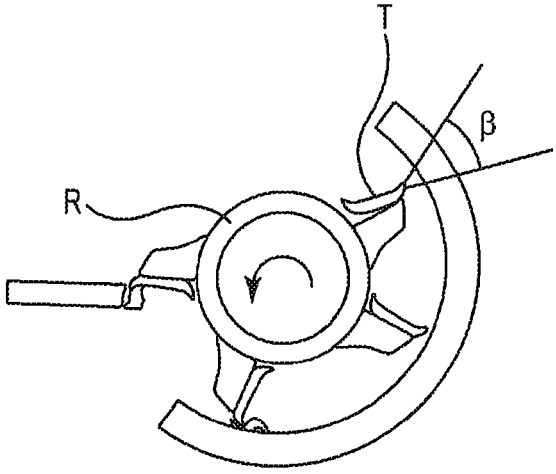
Fig. 4 PRIOR ART
FIG. 4 is a side cutaway view of a prior art grinding rotor and tooth system.

FIG. 4 illustrates a prior art fragmenting device with prior art teeth having these characteristics. As illustrated, the rotor R rotates in the arrow indicated by the arrow and comprises convex-shaped teeth T attached to mounting brackets. Described differently, the convex shape of the teeth comprises an acute angle $\beta$ between the flat middle surface and the angled inner surface of the convex portion of tooth T. These teeth T work to essentially force material encountered radially parallel or inward toward the rotor drum. The cutting and/or splitting force is achieved by the sharp inwardly biased cutting edge which strikes and cuts feed material, e.g., wood. There is also a shearing force established between this tooth cutting edge and the fragmenting device's screen. Several limitations exist with this prior art design, including but not limited to extreme wear on the cutting edge and a leveraging impact on the upper cutting edge which tends to create a damaging force on the tooth T as well as the mounting bracket itself. This force is illustrated by the bottom portion of tooth T being pulled away from mounting bracket. This design is clearly susceptible to improvement.

Figure 5:
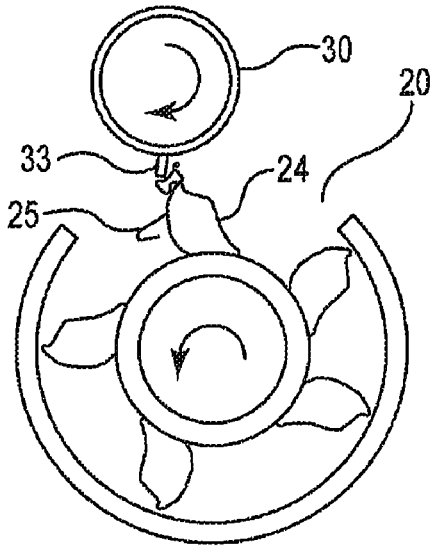
FIG. 5 is a side cutaway view of one embodiment of the present invention.
Figure 6:
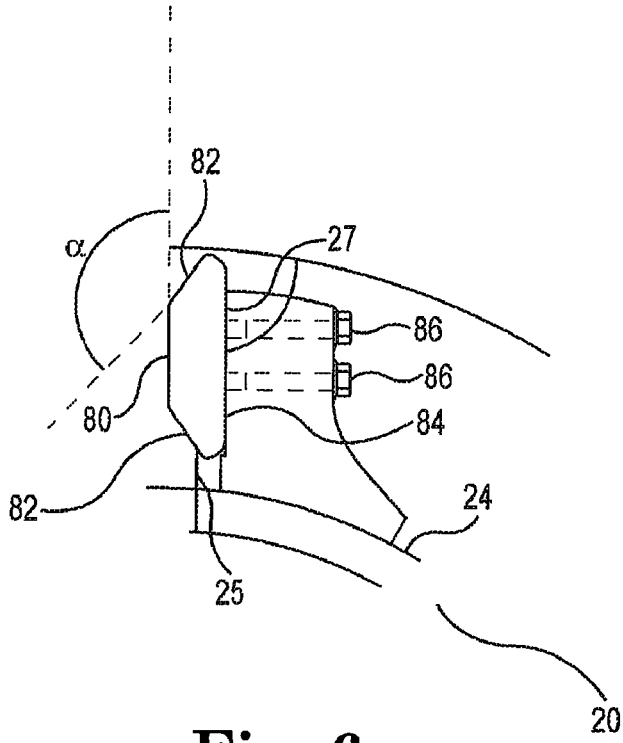
FIG. 6 is a side cutaway view of one embodiment of a rotor tooth of the present invention.

Turning now to FIGS. 5 and 6, the rotor tooth 25 of the present invention will now be described in detail. The teeth 25 comprise a body having a generally flat leading middle surface 80 with at least one angled grinding surface 82 adjacent the leading middle surface 80 and a generally flat rear surface 84. A preferred embodiment of the tooth 25 comprises, as described above, operatively connecting tooth 25 to a mounting bracket 26 wherein the bracket 26 is, preferably, removably and fixedly attached to the outer surface 24 of rotor 20, and wherein the teeth 25 are removably/releasably and fixedly mounted to the leading surface 27 of the corresponding bracket 28. As illustrated, the rear surface 84 of tooth 25 is mounted against leading surface 27 of bracket 28 by, e.g., a pair of bolts 86 to facilitate easy access and removal of the tooth 25 when desired.

Tooth 25 may comprise one angled grinding surface 82, or two angled grinding surfaces 82 may be provided as shown in FIGS. 5 and 6. The preferred angle, $\alpha$, measured relative to the flat leading middle surface 80, is obtuse and is most preferably 125 degrees, though other angles are well within the scope of the present invention and may be optimized to match the particular feed material and/or rotational speed of the rotor 20. For example, the range of angle $\alpha$ for the at least one angled surface 82 may be within 95 degrees to 140 degrees, though the full range of the inventive tooth T comprising 91 degrees to 179 degrees defining obtuse angle $\alpha$ is within the scope of the present invention. The angled surface 82 works to press feed material radially outwardly, thus creating additional fragmenting opportunities. This angled surface 82 further works to extend the life of tooth 25 as compared with known teeth which simply have a flat leading surface without angled surface 82 because, among other things, the tooth 25 of the present invention comprises more surface area than the known flat teeth. Moreover, in the embodiment wherein the tooth 25 comprises two equivalently angled surfaces 82, the tooth 25 may be removed from bracket 28, rotated 180 degrees and reattached to bracket 28, thus presenting a new angled surface 82, thus extending the life of the tooth 25. Further, the two angled surfaces 82 may comprise different angles with respect to the flat leading surface to achieve different fragmenting results and to accommodate various feed/waste materials' characteristics.

The tooth 25 of the present invention further provides general fragmenting efficiencies. Rather than simply cutting or splitting pieces from the larger feed material pieces as to the known teeth, the inventive tooth 25 provides shearing, grating and/or peeling forces. The angled surface 82 of the tooth 25 pushes material outwardly into the anvil's plates 33, the striking bar 70 and into the screen 40. Pushing the material into the anvil's slowly rotating plates 33 and fixed striking bar 70 produce, inter alia, maximized shearing and striking forces to assist in fragmenting the feed material. Pushing the material outwardly via angled surface 82 further pushes the material against the screen 40 in a more efficient manner and produces grating and/or peeling forces which further improve fragmenting efficiency.

In operation then, feed material is provided into the feed chute 60 where the teeth 25 of the rapidly rotating rotor 20 are encountered. The angled surface 82 of each tooth 25 pushes the material forward and upward toward the rotating plates 33 of the rotating anvil 30. When the material encounters the anvil plates 33, a pinch point is created between the oncoming teeth 25 with angled surfaces 82 and the anvil plates 33 which are rotating in the opposite rotational direction (albeit at a much slower rotational speed preferably) as the oncoming teeth 25 of the rotor 20.

The slower rotation of the rotating anvil 30 and plates 33 carries the loose feed material forward and drops the feed material downward once again into the pathways of the oncoming rotor teeth 25. Because the rotating anvil 30 rotates preferably slower than the rotor 20, the anvil plates 33 further provide both shearing and striking surfaces for the oncoming teeth 25 presenting at continually changing angles and distances rather than relying on one single angle and distance as do the known fixed anvils. The teeth 25 comprise angled surfaces 82 that move the material forward but more importantly upwardly into the pathway of the slowly rotating anvil plates 33. The effect of this arrangement is a striking and shearing effect and striking and shearing zone with changing striking/shearing angles and distances. Thus, the present invention ensures that as much of the feed material as possible is broken down before making even one revolution around the fragmenting and/or grinding chamber Fc which houses the fragmenting rotor 20, thus increasing efficiency of the fragmenting process. Moreover, since the feed material is delivered to the rotor 20 by gravity via the feed chute 60, the rotating anvil 30 may regulate how much material is carried forward into the screen(s) 40.

After the feed material encounters and passes through the striking and shearing zone, comprising the proximal point for the plates 33 and teeth 25, the material is then driven by the teeth 25 into the stationary strike plate 70 where further fragmentation occurs and then further still into the screen(s) 40 where grating and shearing forces fragment the material still further. The material between the rotating teeth 25 and the screen(s) 40 are continually driven forward and upward against the screen by the angled surface 82 of the teeth 25. Further, the feed material will be forced into another pinch point between the tip of the tooth 25 and the screen 40 where the material is subjected to grating, shearing and peeling forces until the material is sufficiently small to pass through the screen.

The present invention provides many advantages over existing gravity-fed fragmenting machines in regard to maintenance, as well. The rotating anvil plates 33 provide a collective surface area that is much larger than a traditional fixed anvil and wears much more slowly since the wear is spread out over multiple striking plates 33. In addition, the anvil drum 31 provides additional surface area which further spreads out wear, extending the life of the plates 33. The design allows wear plates (not shown) to be quickly mounted to each striking plate 33, essentially bolting the wear plates to the plate 33 surface to increase wear thickness, without moving the screening apparatus. The wear plates are preferably in the same shape and profile as plates 33 to continue the functional advantages realized therefrom. The anvil 30 can be rotated to give maintenance personnel convenient access to each striking plate 33 for inspection and repair. The continuous rotation prevents heat from building on one specific portion of the anvil 30 which is advantageous since heat generated by the grinding process can accelerate the wear of a traditional anvil.

A method according to the present invention may comprise:

providing a fragmenting rotor with fragmenting teeth;

providing a rotating anvil above the fragmenting rotor and having a drum and striking plates attached to the drum;

ensuring the rotor and anvil are rotating in opposing directions;

providing a feed chute;

feeding material into the feed chute in a generally downward direction;

ensuring the feed material fed into the feed chute first encounters oncoming fragmenting teeth of the fragmenting rotor rotating in an opposing direction to the feed material's feed direction; and ensuring the feed material next encounters at least one of the striking plates and/or drum of the rotating anvil.

Further method steps according to the present invention comprise providing ensuring the feed material next encounters a fixed striking plate, wherein the rotating anvil redirects upwardly moving feed material back into the path of oncoming rotor teeth; and/or providing fragmenting teeth having an angled surface to push feed material forward and upwardly against the anvil plates, the striking plate and/or against the screen to improve fragmenting efficiencies.

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

What is claimed is:

1. A gravity-fed fragmenting machine having a frame and comprising:

a feed chute attached to the frame for feeding waste materials to the machine in a generally downward direction;

an at least partially enclosed fragmenting chamber attached to the frame and in operative communication with the feed chute, the fragmenting chamber defined at least partially by fragmenting screens and housing a fixed strike plate and a fragmenting rotor therein, the fragmenting rotor further comprising an axis of rotation, a drum having an outer surface, a plurality of mounting brackets attached to the drum's outer surface in rows with varying axial distances between the brackets; and a rotor tooth releasably attached to each of the plurality of mounting brackets;

a rotating anvil in operative communication with the fragmenting rotor and the feed chute, the rotating anvil further comprising an axis of rotation, a drum and more than one striking plate attached to the drum, wherein the axis of rotation of the rotating anvil is parallel to the axis of rotation of the fragmenting rotor and is located above, and offset from, the axis of rotation of the fragmenting rotor, wherein the fragmenting rotor and the rotating anvil are operatively connected to a motorized means for rotatingly driving the rotor and the anvil in opposite rotational directions, the rotational direction of the rotor being in opposition to the generally downward direction of the waste materials moving down the feed chute, and wherein the rotating anvil redirects upwardly moving feed material back into the path of rotating rotor teeth.

2. The fragmenting machine of claim 1, further comprising the rotating anvil and fragmenting rotor each having a rotational speed, the rotational speed of the rotating anvil being slower than the rotational speed of the fragmenting rotor.

3. The fragmenting machine of claim 1, wherein each of the rotor teeth comprise a body having a generally flat leading middle surface, at least one angled grinding surface adjacent the leading middle surface and having an obtuse angle relative to the leading middle surface, and a generally flat rear surface.

4. The fragmenting machine of claim 3, wherein the at least one angled grinding surface comprises an angle with respect to the generally flat leading middle surface of 125 degrees.

5. The fragmenting machine of claim 3, wherein the at least one angled grinding surface comprises an angle within the range of 95 degrees to 140 degrees.

6. The fragmenting machine of claim 3, further comprising two angled grinding surfaces.

7. The fragmenting machine of claim 6, wherein the two angled grinding surface comprise equivalent angles with respect to the generally flat leading middle surface.

8. The fragmenting machine of claim 6, wherein the two angled grinding surface comprise non-equivalent angles with respect to the generally flat leading middle surface.

9. A method for improving the efficiency of a fragmenting machine, comprising:

providing a fragmenting machine having a fragmenting rotor with a plurality of removably attached fragmenting teeth mounted thereon in rows with varying axial distances between teeth;

providing a rotating anvil mounted to the fragmenting machine and above the fragmenting rotor and having a drum and striking plates attached to the drum;

rotating the rotor at a rotational speed;

rotating the rotating anvil at a rotational speed that is slower than the rotor's rotational speed;

feeding material into the feed chute in a generally downward direction;

ensuring the rotor and anvil are rotating in opposite directions and wherein the rotor is rotating in an opposing and non-complementary direction to the generally downward direction of the incoming feed material;

ensuring the feed material fed into the feed chute encounters the oncoming fragmenting teeth of the fragmenting rotor;

ensuring the feed material encounters at least one of the striking plates and/or drum of the rotating anvil; and ensuring the feed material encounters a fixed striking plate, wherein the rotating anvil redirects upwardly moving feed material back into the path of rotating rotor teeth.

10. The method of claim 9, further comprising allowing the striking plates of the rotating anvil to agitate the feed material.

11. The method of claim 9, further comprising providing at least one fragmenting screen against which the fragmenting teeth grind the feed material.

12. The method of claim 9, further comprising providing the fragmenting teeth with at least one angled surface to push feed material forward and upwardly against the anvil plates, the striking plate and/or against the screen to improve fragmenting efficiencies.

* * * * *